US009210521B2

(12) United States Patent
Kasic et al.

(10) Patent No.: US 9,210,521 B2
(45) Date of Patent: Dec. 8, 2015

(54) ABUTMENT ATTACHMENT SYSTEMS, MECHANISMS, DEVICES, COMPONENTS AND METHODS FOR BONE CONDUCTION HEARING AIDS

(71) Applicant: Sophono, Inc., Boulder, CO (US)

(72) Inventors: James F. Kasic, Boulder, CO (US); Nicholas F. Pergola, Arvada, CO (US); Markus C. Haller, Gland (CH)

(73) Assignee: SOPHONO, INC., Boulder, CO (US)

( * ) Notice: Subject to any disclaimer, the term of this patent is extended or adjusted under 35 U.S.C. 154(b) by 231 days.

(21) Appl. No.: 13/650,080

(22) Filed: Oct. 11, 2012

(65) Prior Publication Data

US 2014/0121452 A1 May 1, 2014

Related U.S. Application Data

(63) Continuation-in-part of application No. 13/550,581, filed on Jul. 16, 2012.

(51) Int. Cl.
*H04R 25/00* (2006.01)
*H04R 3/00* (2006.01)

(52) U.S. Cl.
CPC ..... *H04R 25/606* (2013.01); *H04R 3/002* (2013.01); *H04R 2460/13* (2013.01)

(58) Field of Classification Search
CPC ... H04R 25/606; H04R 2460/13; H04R 3/002
USPC ..... 600/25
See application file for complete search history.

(56) References Cited

U.S. PATENT DOCUMENTS

| | | | | |
|---|---|---|---|---|
| 2,459,325 | A * | 1/1949 | Knowles | 381/151 |
| 4,352,960 | A | 10/1982 | Dormer et al. | |
| 4,612,915 | A | 9/1986 | Hough et al. | |
| 4,726,378 | A | 2/1988 | Kaplan | |
| 4,736,747 | A | 4/1988 | Drake | |
| RE32,947 | E | 6/1989 | Dormer | |
| 4,918,745 | A | 4/1990 | Hutchison | |
| 5,558,618 | A | 9/1996 | Maniglia | |

(Continued)

FOREIGN PATENT DOCUMENTS

| | | | |
|---|---|---|---|
| DE | 202004006117 | U1 | 7/2004 |
| DE | 202004008719 | U1 | 10/2004 |

(Continued)

OTHER PUBLICATIONS

"A Miniature Bone Vibrator for Hearing Aids and Similar Applications." BHM-Tech Produktiongesellschaft m.b.H, Austria, 2004, Technical Data VKH3391W.

(Continued)

*Primary Examiner* — Christine H Matthews
*Assistant Examiner* — Joshua D Lannu
(74) *Attorney, Agent, or Firm* — Jeffrey J. Hohenshell

(57) ABSTRACT

Various embodiments of systems, devices, components, and methods are disclosed for mechanically coupling a bone conduction hearing aid, or a spacer or other device for a bone conduction hearing aid, to an abutment of a bone screw affixed to a patient's skull. Some embodiments of abutment attachment mechanisms employ axially-directed forces to secure a hearing aid to an abutment of a bone screw, while others employ radially directed forces to secure a hearing aid to an abutment of a bone screw.

33 Claims, 11 Drawing Sheets

(56) References Cited

U.S. PATENT DOCUMENTS

| | | | | |
|---|---|---|---|---|
| 5,906,635 | A | 5/1999 | Maniglia | |
| 6,032,677 | A | 3/2000 | Blechman et al. | |
| 6,246,911 | B1 | 6/2001 | Seligman | |
| 6,358,281 | B1 | 3/2002 | Berrang et al. | |
| 6,517,476 | B1 | 2/2003 | Bedoya et al. | |
| 6,537,200 | B2 | 3/2003 | Leysieffer et al. | |
| 6,565,503 | B2 | 5/2003 | Leysieffer et al. | |
| 6,648,914 | B2 | 11/2003 | Berrang et al. | |
| 7,021,676 | B2 | 4/2006 | Westerkull | |
| 7,065,223 | B2 | 6/2006 | Westerkull | |
| 7,186,211 | B2 | 3/2007 | Schneider et al. | |
| 7,386,143 | B2 | 6/2008 | Easter et al. | |
| 7,599,508 | B1 | 10/2009 | Lynch et al. | |
| 7,856,986 | B2 | 12/2010 | Darley | |
| 8,107,661 | B1 | 1/2012 | Lynch et al. | |
| 8,170,253 | B1 | 5/2012 | Lynch et al. | |
| 8,254,610 | B2 | 8/2012 | Heerlein et al. | |
| 8,255,058 | B2 | 8/2012 | Gibson et al. | |
| 8,270,647 | B2 | 9/2012 | Crawford et al. | |
| 8,315,705 | B2 | 11/2012 | Keuninckx | |
| 8,369,959 | B2 | 2/2013 | Meskens | |
| 8,406,443 | B2 | 3/2013 | Westerkull et al. | |
| 8,452,412 | B2 | 5/2013 | Ibrahim | |
| 8,515,112 | B2 | 8/2013 | Crawford et al. | |
| 8,538,545 | B2 | 9/2013 | Meskens | |
| 8,774,930 | B2 | 7/2014 | Ball | |
| 8,787,608 | B2 | 7/2014 | Van Himbeeck et al. | |
| 8,811,643 | B2 | 8/2014 | Crawford et al. | |
| 8,891,795 | B2 | 11/2014 | Andersson | |
| 8,897,475 | B2 | 11/2014 | Ball et al. | |
| 8,897,883 | B2 | 11/2014 | Griffith | |
| 8,923,968 | B2 | 12/2014 | Meskens | |
| 8,934,984 | B2 | 1/2015 | Meskens et al. | |
| 9,020,174 | B2 | 4/2015 | Asnes | |
| 2006/0058819 | A1 | 3/2006 | Kasic, II et al. | |
| 2007/0053536 | A1 | 3/2007 | Westerkull | |
| 2007/0270684 | A1 | 11/2007 | Cawley et al. | |
| 2007/0274551 | A1 | 11/2007 | Tsai et al. | |
| 2009/0245554 | A1 * | 10/2009 | Parker | 381/326 |
| 2009/0248155 | A1 | 10/2009 | Parker | |
| 2009/0299437 | A1 | 12/2009 | Zimmerling | |
| 2010/0145135 | A1 | 6/2010 | Ball et al. | |
| 2011/0022120 | A1 | 1/2011 | Ball et al. | |
| 2011/0216927 | A1 | 9/2011 | Ball | |
| 2012/0029267 | A1 | 2/2012 | Ball | |
| 2012/0041515 | A1 | 2/2012 | Meskens et al. | |
| 2012/0078035 | A1 | 3/2012 | Andersson et al. | |
| 2012/0080039 | A1 | 4/2012 | Siegert | |
| 2012/0088957 | A1 | 4/2012 | Adamson et al. | |
| 2012/0238799 | A1 | 9/2012 | Ball et al. | |
| 2012/0294466 | A1 | 11/2012 | Kristo et al. | |
| 2012/0296155 | A1 | 11/2012 | Ball | |
| 2012/0302823 | A1 | 11/2012 | Andersson et al. | |
| 2013/0018218 | A1 | 1/2013 | Haller et al. | |
| 2013/0046131 | A1 | 2/2013 | Ball et al. | |
| 2013/0150657 | A1 | 6/2013 | Leigh et al. | |
| 2013/0261377 | A1 | 10/2013 | Adamson et al. | |
| 2013/0281764 | A1 | 10/2013 | Bjorn et al. | |
| 2014/0064531 | A1 | 3/2014 | Andersson et al. | |
| 2014/0121415 | A1 | 5/2014 | Kasic et al. | |
| 2014/0121447 | A1 | 5/2014 | Kasic et al. | |
| 2014/0121449 | A1 | 5/2014 | Kasic et al. | |
| 2014/0121450 | A1 | 5/2014 | Kasic et al. | |
| 2014/0121451 | A1 | 5/2014 | Kasic et al. | |
| 2014/0153737 | A1 | 6/2014 | Geschiere | |
| 2014/0163692 | A1 | 6/2014 | Van Den Heuvel et al. | |
| 2014/0193011 | A1 | 7/2014 | Parker | |
| 2014/0270293 | A1 | 9/2014 | Ruppersberg et al. | |
| 2014/0275731 | A1 | 9/2014 | Andersson et al. | |
| 2014/0275735 | A1 | 9/2014 | Ruppersberg et al. | |
| 2014/0275736 | A1 | 9/2014 | Ruppersberg et al. | |
| 2014/0336447 | A1 | 11/2014 | Bjorn et al. | |
| 2015/0016649 | A1 | 1/2015 | Van Himbeeck et al. | |
| 2015/0038775 | A1 | 2/2015 | Ruppersberg | |
| 2015/0043766 | A1 | 2/2015 | Westerkull | |
| 2015/0063616 | A1 | 3/2015 | Westerkull | |
| 2015/0141740 | A1 | 5/2015 | Miller | |
| 2015/0146902 | A1 | 5/2015 | Jinton et al. | |
| 2015/0156594 | A1 | 6/2015 | Bervoets | |

FOREIGN PATENT DOCUMENTS

| | | | |
|---|---|---|---|
| DE | 202005015533 | U1 | 2/2006 |
| DE | 202006004445 | | 5/2006 |
| DE | 202005009361 | U1 | 11/2006 |
| DE | 102006026288 | A1 | 1/2007 |
| DE | 202009003507 | U1 | 7/2009 |
| DE | 202009003508 | U1 | 7/2009 |
| DE | 202009003509 | U1 | 7/2009 |
| DE | 202009005475 | | 7/2009 |
| DE | 202009005936 | | 8/2009 |
| DE | 202009007401 | | 10/2009 |
| DE | 112010001095 | | 10/2012 |
| EP | 755169 | | 5/1996 |
| JP | 2011-87142 | | 4/2011 |
| WO | 2010/105601 | | 9/2010 |
| WO | 2015/020753 | A2 | 2/2015 |
| WO | 2015/034582 | A2 | 3/2015 |

OTHER PUBLICATIONS

"Microphone 8010T", Data Sheet, RoHS, Sonion, Dec. 20, 2007.
"Inspiria Extreme Digital DSP System," Preliminary Data Sheet, Sound Design Technologies, Mar. 2009.
"Alpha I (S) & Alpha I (M) Bone Conduction Hearing Systems," Physician Manual, Sophono.

* cited by examiner

AUDIANT
(PRIOR ART)

BAHA
(PRIOR ART)

ALPHA 1
(PRIOR ART)

ABUTMENT ATTACHMENT SYSTEMS, MECHANISMS, DEVICES, COMPONENTS AND METHODS FOR BONE CONDUCTION HEARING AIDS

RELATED APPLICATIONS

This application is a continuation-in-part of, and claims priority and other benefits from, U.S. patent application Ser. No. 13/550,581 entitled "Systems, Devices, Components and Methods for Bone Conduction Hearing Aids" to Pergola et al. filed Jul. 16, 2012 (hereafter "the '581 patent application"), now abandoned. The '581 patent application is hereby incorporated by reference herein, in its entirety.

This application also hereby incorporates by reference, each in its respective entirety, the following patent applications filed on even date herewith: (1) U.S. patent application Ser. No. 13/649,934 entitled "Adjustable Magnetic Systems, Devices, Components and Methods for Bone Conduction Hearing Aids" to Kasic et al.; (2) U.S. patent application Ser. No. 13/650,026 entitled "Magnetic Abutment Systems, Devices, Components and Methods for Bone Conduction Hearing Aids" to Kasic et al., and (3) U.S. patent application Ser. No. 13/650,057 entitled "Magnetic Spacer Systems, Devices, Components and Methods for Bone Conduction Hearing Aids" to Kasic et al., now U.S. Pat. No. 9,022,917.

FIELD OF THE INVENTION

Various embodiments of the invention described herein relate to the field of systems, devices, components, and methods for bone conduction hearing aid devices.

BACKGROUND

A bone-anchored hearing device (or "BAHD") is an auditory prosthetic device based on bone conduction having a portion or portions thereof which are surgically implanted. A BAHD uses the bones of the skull as pathways for sound to travel to a patient's inner ear. For people with conductive hearing loss, a BAHD bypasses the external auditory canal and middle ear, and stimulates the still-functioning cochlea via an implanted metal post. For patients with unilateral hearing loss, a BAHD uses the skull to conduct the sound from the deaf side to the side with the functioning cochlea. In most BAHA systems, a titanium post or plate is surgically embedded into the skull with a small abutment extending through and exposed outside the patient's skin. A BAHD sound processor attaches to the abutment and transmits sound vibrations through the external abutment to the implant. The implant vibrates the skull and inner ear, which stimulates the nerve fibers of the inner ear, allowing hearing. A BAHD device can also be connected to an FM system or iPod by means of attaching a miniaturized FM receiver or Bluetooth connection thereto.

BAHD devices manufactured by COCHLEAR™ of Sydney, Australia, and OPTICON™ of Smoerum, Sweden. SOPHONO™ of Boulder, Colo. manufactures a an ALPHA 1 magnetic hearing aid device, which attaches by magnetic means behind a patient's ear to the patient's skull by coupling to a magnetic or magnetized bone plate (or "magnetic implant") implanted in the patient's skull beneath the skin.

Surgical procedures for implanting such posts or plates are relatively straightforward, and are well known to those skilled in the art. See, for example, "Alpha I (S) & Alpha I (M) Physician Manual—REV A S0300-00" published by Sophono, Inc. of Boulder, Colo., the entirety of which is hereby incorporated by reference herein.

Hearing aid devices and systems offered by different manufacturers are often incompatible with one another such that external hearing aids provided by one manufacturer cannot be used in conjunction with bone screws or magnetic implants provided by another manufacturer. This results in patients and health care providers being unable to mix or combine, by way of example, hearing aids provided by one manufacturer with bone screws or magnetic implants provided by another manufacturer.

What is needed is the ability of patients and health care providers to employ hearing aid system components or devices provided by one manufacturer with those of another manufacturer.

SUMMARY

In one embodiment, there is provided a hearing aid system comprising a bone conduction hearing aid comprising an electromagnetic ("EM") transducer and a hearing aid abutment attachment mechanism operably coupled to the EM transducer, the abutment attachment mechanism being configured to be mechanically and acoustically coupled to a hearing aid abutment attached to or forming an external portion of a bone screw implanted in a patient's skull, wherein the abutment attachment mechanism is further configured to fit onto or over the hearing aid abutment and apply compressive axially directed forces between tapered or curved outer shoulders of a shank of the abutment and at least one of: (i) an upper edge of the abutment, and (ii) a recess located in the abutment, such that the abutment attachment mechanism and corresponding hearing aid may be operably coupled and mechanically secured to the abutment.

In another embodiment, there is provided an abutment attachment mechanism configured for use in a hearing aid system that includes a bone conduction hearing aid comprising an electromagnetic ("EM") transducer, the abutment attachment mechanism being configured to be operably coupled to the EM transducer and to be mechanically and acoustically coupled to a hearing aid abutment attached to or forming an external portion of a bone screw implanted in a patient's skull, wherein the abutment attachment mechanism is further configured to fit onto or over the hearing aid abutment and apply compressive axially directed forces between tapered or curved outer shoulders of a shank of the abutment and at least one of: (i) an upper edge of the abutment, and (ii) a recess located in the abutment, such that the abutment attachment mechanism and corresponding hearing aid may be operably coupled and mechanically secured to the abutment.

In yet another embodiment, there is provided a hearing aid system comprising a bone conduction hearing aid comprising an electromagnetic ("EM") transducer and a hearing aid abutment attachment mechanism operably coupled to the EM transducer, the abutment attachment mechanism being configured to be mechanically and acoustically coupled to a hearing aid abutment attached to or forming an external portion of a bone screw implanted in a patient's skull, wherein the abutment attachment mechanism is further configured to fit onto or over the hearing aid abutment and to apply radially outwardly directed forces to a recess located in the abutment, such that the abutment attachment mechanism and corresponding hearing aid may be operably coupled and mechanically secured to the abutment.

Further embodiments are disclosed herein or will become apparent to those skilled in the art after having read and understood the specification and drawings hereof.

BRIEF DESCRIPTION OF THE DRAWINGS

Different aspects of the various embodiments will become apparent from the following specification, drawings and claims in which:

FIG. 2(*b*) shows one embodiment of a prior art wiring diagram for a SOPHONO ALPHA 1 hearing aid manufactured using an SA3286 DSP;

FIG. 3(*b*) shows one embodiment of a prior art SOPHONO® ALPHA 1® hearing aid 10;

The drawings are not necessarily to scale. Like numbers refer to like parts or steps throughout the drawings.

DETAILED DESCRIPTIONS OF SOME EMBODIMENTS

Described herein are various embodiments of systems, devices, components and methods for bone conduction and/or bone-anchored hearing aids.

A bone-anchored hearing device (or "BAHD") is an auditory prosthetic device based on bone conduction having a portion or portions thereof which are surgically implanted. A BAHD uses the bones of the skull as pathways for sound to travel to a patient's inner ear. For people with conductive hearing loss, a BAHD bypasses the external auditory canal and middle ear, and stimulates the still-functioning cochlea via an implanted metal post. For patients with unilateral hearing loss, a BAHD uses the skull to conduct the sound from the deaf side to the side with the functioning cochlea. In most BAHA systems, a titanium post or plate is surgically embedded into the skull with a small abutment extending through and exposed outside the patient's skin. A BAHD sound processor attaches to the abutment and transmits sound vibrations through the external abutment to the implant. The implant vibrates the skull and inner ear, which stimulates the nerve fibers of the inner ear, allowing hearing. A BAHD device can also be connected to an FM system or iPod by means of attaching a miniaturized FM receiver or Bluetooth connection thereto.

BAHD devices manufactured by COCHLEAR™ of Sydney, Australia, and OPTICON™ of Smoerum, Sweden. SOPHONO™ of Boulder, Colo. manufactures an Alpha 1 magnetic hearing aid device, which attaches by magnetic means behind a patient's ear to the patient's skull by coupling to a magnetic or magnetized bone plate (or "magnetic implant") implanted in the patient's skull beneath the skin.

Surgical procedures for implanting such posts or plates are relatively straightforward, and are well known to those skilled in the art. See, for example, "Alpha I (S) & Alpha I (M) Physician Manual—REV A S0300-00" published by Sophono, Inc. of Boulder, Colo., the entirety of which is hereby incorporated by reference herein.

Figure 1C:
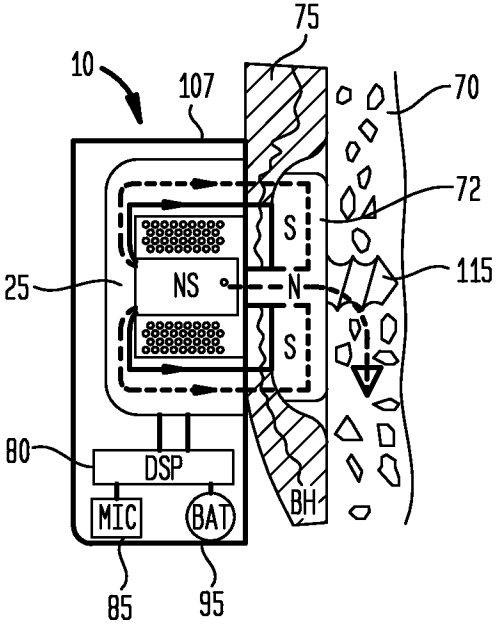
FIGS. 1(*a*), 1(*b*) and 1(*c*) show side cross-sectional schematic views of selected embodiments of prior art SOPHONO ALPHA 1, BAHA and AUDIANT bone conduction hearing aids, respectively.
Figure 1B:
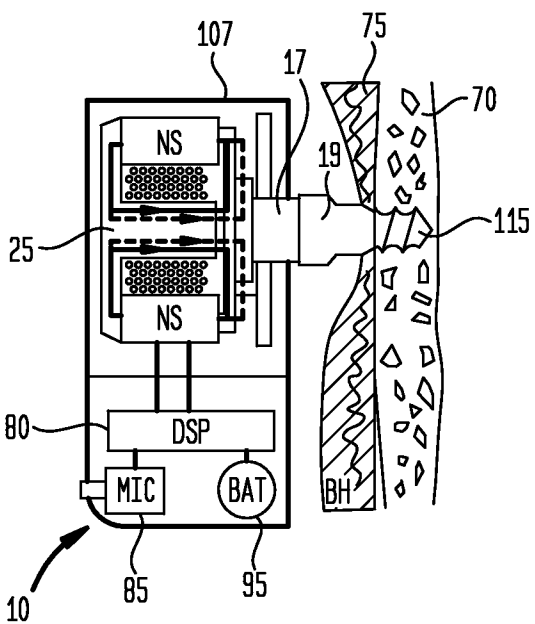
Figure 1A:
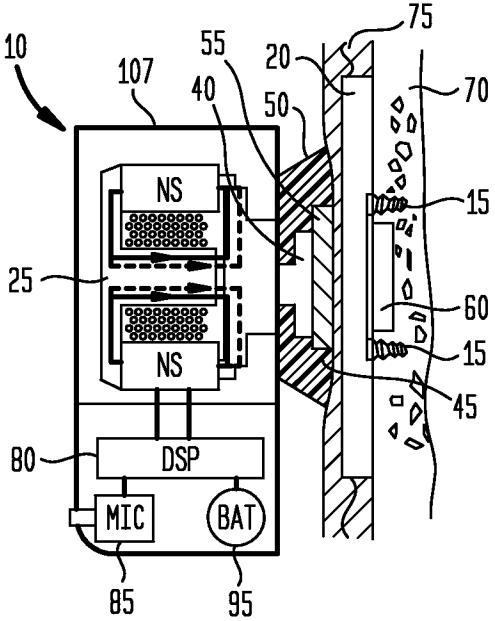

FIGS. 1(*a*), 1(*b*) and 1(*c*) show side cross-sectional schematic views of selected embodiments of prior art SOPHONO ALPHA 1, BAHA and AUDIANT bone conduction hearing aids, respectively. Note that FIGS. 1(*a*), 1(*b*) and 1(*c*) are not necessarily to scale.

In FIG. 1(*a*), magnetic hearing aid device 10 comprises housing 107, electromagnetic/bone conduction ("EM") transducer 25 with corresponding magnets and coils, digital signal processor ("DSP") 80, battery 95, magnetic spacer 50, magnetic implant or magnetic implant bone plate 20. As shown in FIGS. 1(*a*) and 2(*a*), and according to one embodiment, magnetic implant 20 comprises a frame 21 (see FIG. 3(*a*)) formed of a biocompatible metal such as medical grade titanium that is configured to have disposed therein or have attached thereto implantable magnets or magnetic members 60. Bone screws 15 secure or affix magnetic implant 20 to skull 70, and are disposed through screw holes 22 of frame 21 (see FIG. 2(*a*)). Magnetic members 60 are configured to couple magnetically to one or more corresponding external magnetic members or magnets 55 mounted onto or into, or otherwise forming a portion of, magnetic spacer 50, which in turn is operably coupled to EM transducer 25 and metal disc 40. DSP 80 is configured to drive EM transducer 25, metal disk 40 and magnetic spacer 50 in accordance with external audio signals picked up by microphone 85. DSP 80 and EM transducer 25 are powered by battery 95, which according to one embodiment may be a zinc-air battery, or may be any other suitable type of primary or secondary (i.e., rechargeable) electrochemical cell such as an alkaline or lithium battery.

As further shown in FIG. 1(*a*), magnetic implant 20 is attached to patient's skull 70, and is separated from magnetic spacer 50 by patient's skin 75. Hearing aid device 10 of FIG. 1(*a*) is thereby operably coupled magnetically and mechanically to plate 20 implanted in patient's skull 70, which permits the transmission of audio signals originating in DSP 80 and EM transducer 25 to the patient's inner ear via skull 70.

FIG. 1(*b*) shows another embodiment of hearing aid 10, which is a BAHA® device comprising housing 107, EM transducer 25 with corresponding magnets and coils, DSP 80, battery 95, external post 17, internal bone anchor 115, and abutment member 19. In one embodiment, and as shown in FIG. 1(*b*), internal bone anchor 115 includes a bone screw formed of a biocompatible metal such as titanium that is configured to have disposed thereon or have attached thereto abutment member 19, which in turn may be configured to mate mechanically or magnetically with external post 17, which in turn is operably coupled to EM transducer 25. DSP 80 is configured to drive EM transducer 25 and external post 17 in accordance with external audio signals picked up by microphone 85. DSP 80 and EM transducer 25 are powered by battery 95, which according to one embodiment is a zinc-air battery (or any other suitable battery or electrochemical cell as described above). As shown in FIG. 1(*b*), implantable bone anchor 115 is attached to patient's skull 70, and is also attached to external post 17 through abutment member 19, either mechanically or by magnetic means. Hearing aid device 10 of FIG. 1(*b*) is thus coupled magnetically and/or mechanically to bone anchor 15 implanted in patient's skull 70, thereby permitting the transmission of audio signals originating in DSP 80 and EM transducer 25 to the patient's inner ear via skull 70.

FIG. 1(*c*) shows another embodiment of hearing aid 10, which is an AUDIANT®-type device, where an implantable magnetic member 72 is attached by means of bone anchor 115 to patient's skull 70. Internal bone anchor 115 includes a bone screw formed of a biocompatible metal such as titanium, and has disposed thereon or attached thereto implantable magnetic member 72, which couples magnetically through patient's skin 75 to EM transducer 25. DSP 80 is configured to drive EM transducer 25 in accordance with external audio signals picked up by microphone 85. Hearing aid device 10 of FIG. 1(*c*) is thus coupled magnetically to bone anchor 15 implanted in patient's skull 70, thereby permitting the transmission of audio signals originating in DSP 80 and EM transducer 25 to the patient's inner ear via skull 70.

Figure 2A:
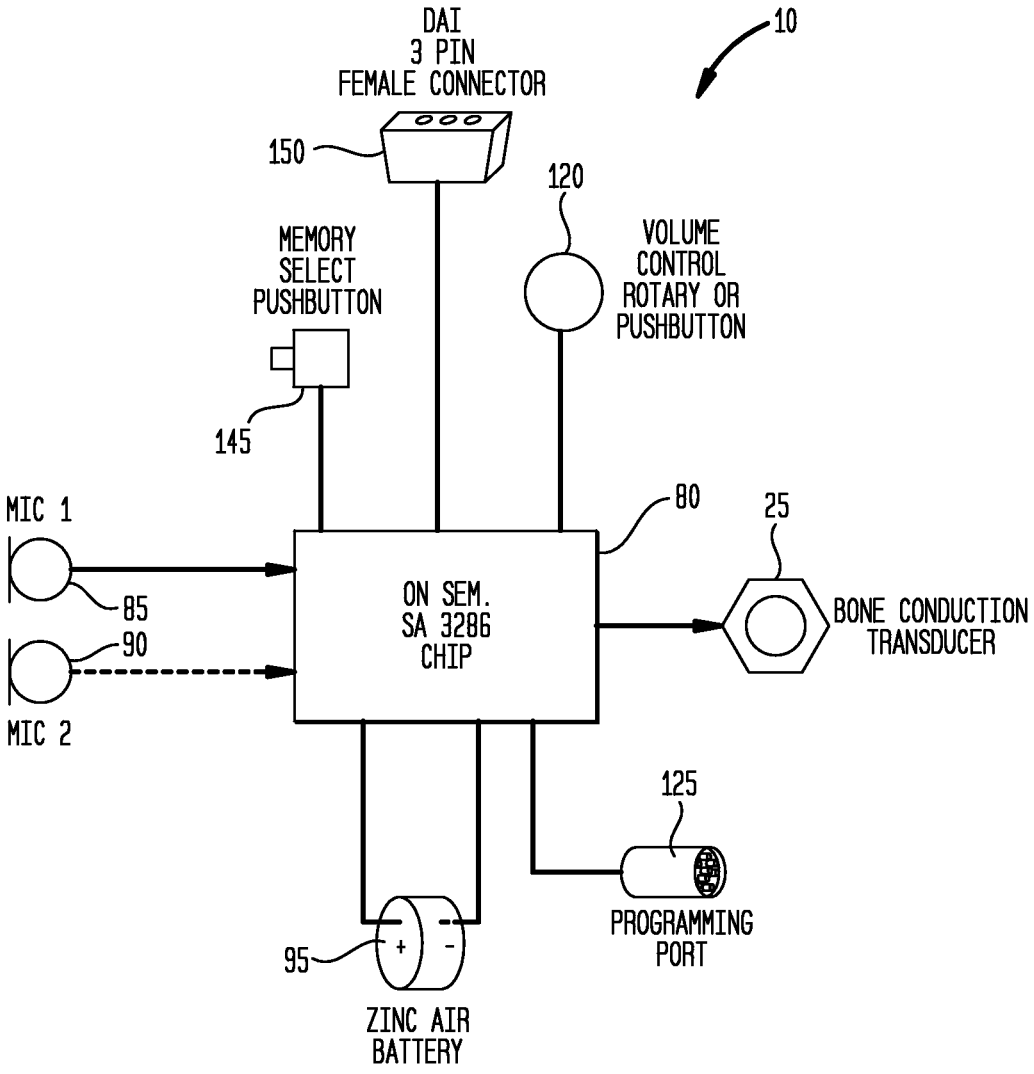
FIG. 2(a) (PRIOR ART)
FIG. 2(*a*) shows one embodiment of a prior art functional electronic and electrical block diagram of hearing aid 10 shown in FIGS. 1(*a*) and 3(*b*)
Figure 2B:
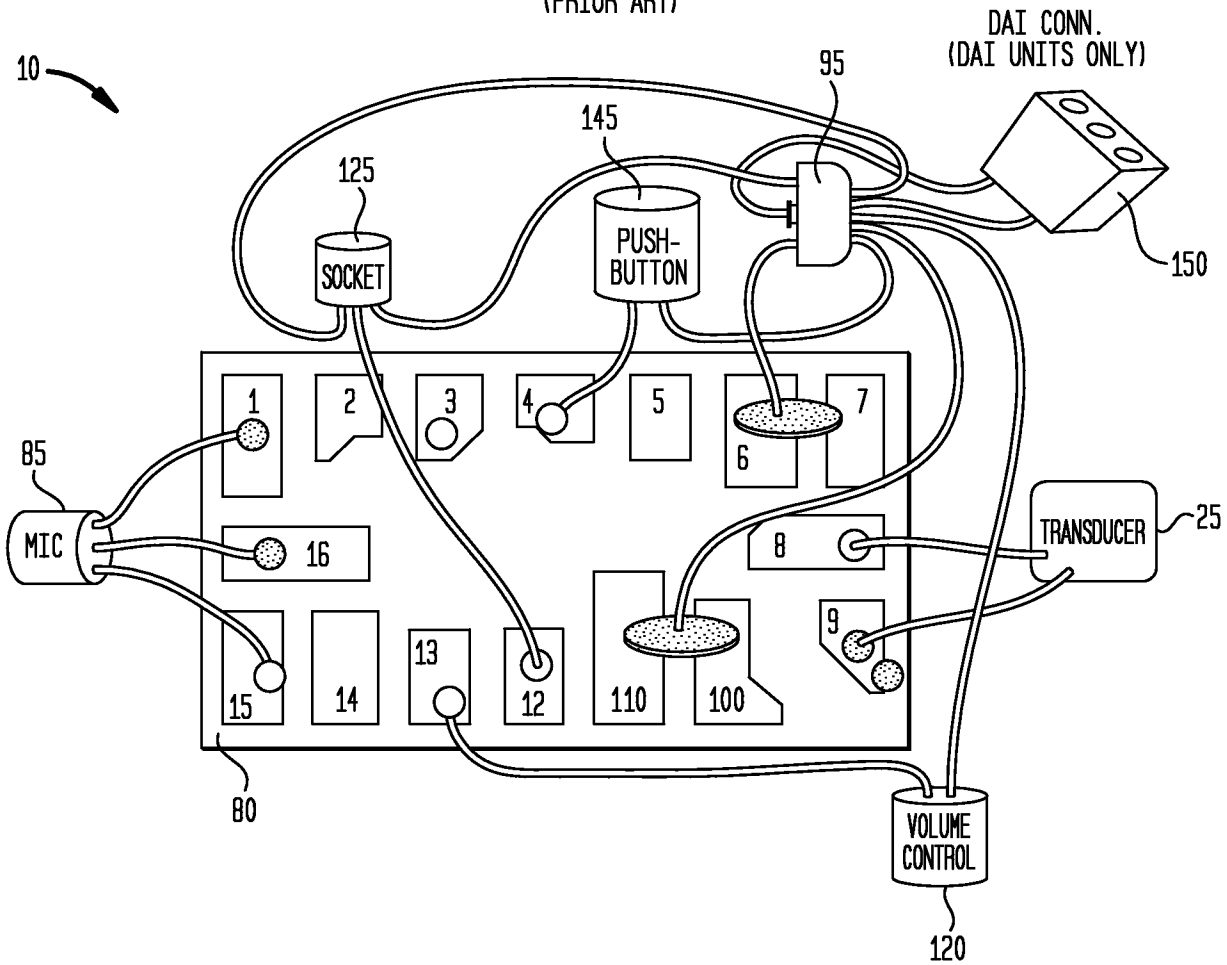
FIG. 2(b) (PRIOR ART)

FIG. 2(*a*) shows one embodiment of a prior art functional electronic and electrical block diagram of hearing aid 10 shown in FIGS. 1(*a*) and 2(*b*). In the block diagram of FIG. 2(*a*), and according to one embodiment, DSP 80 is a SOUND DESIGN TECHNOLOGIES® SA3286 INSPIRA EXTREME® DIGITAL DSP, for which data sheet 48550-2 dated March 2009, filed on even date herewith in an accompanying Information Disclosure Statement ("IDS"), is hereby incorporated by reference herein in its entirety. The audio processor for the SOPHONO ALPHA 1 hearing aid is centered around DSP chip 80, which provides programmable signal processing. The signal processing may be customized by computer software which communicates with the Alpha through programming port 125. According to one embodiment, the system is powered by a standard zinc air battery 95 (i.e. hearing aid battery), although other types of batteries may be employed. The SOPHONO ALPHA 1 hearing aid detects acoustic signals using a miniature microphone 85. A second microphone 90 may also be employed, as shown in FIG. 2(*a*). The SA 3286 chip supports directional audio processing with second microphone 90 to enable directional processing. Direct Audio Input (DAI) connector 150 allows connection of accessories which provide an audio signal in addition to or in lieu of the microphone signal. The most common usage of the DAI connector is FM systems. The FM receiver may be plugged into DAI connector 150. Such an FM transmitter can be worn, for example, by a teacher in a classroom to ensure the teacher is heard clearly by a student wearing hearing aid 10. Other DAI accessories include an adapter for a music player, a telecoil, or a Bluetooth phone accessory. According to one embodiment, DSP 80 or SA 3286 has 4 available program memories, allowing a hearing health professional to customize each of 4 programs for different listening situations. The Memory Select Pushbutton 145 allows the user to choose from the activated memories. This might include special frequency adjustments for noisy situations, or a program which is Directional, or a program which uses the DAI input.

FIG. 2(*b*) shows one embodiment of a prior art wiring diagram for a SOPHONO ALPHA 1 hearing aid manufactured using the foregoing SA3286 DSP. Note that the various embodiments of hearing aid 10 are not limited to the use of a SA3286 DSP, and that any other suitable CPU, processor, controller or computing device may be used. According to one embodiment, DSP 80 is mounted on a printed circuit board 155 disposed within housing 110 and/or housing 115 of hearing aid 10 (not shown in the Figures).

In some embodiments, the microphone incorporated into hearing aid 10 is an 8010T microphone manufactured by SONION®, for which data sheet 3800-3016007, Version 1 dated December, 2007, filed on even date herewith in the accompanying IDS, is hereby incorporated by reference herein in its entirety. Other suitable types of microphones, including other types of capacitive microphones, may be employed.

In still further embodiments, the electromagnetic transducer 25 incorporated into hearing aid 10 is a VKH3391W transducer manufactured by BMH-Tech® of Austria, for which the data sheet filed on even date herewith in the accompanying IDS is hereby incorporated by reference herein in its entirety. Other types of suitable EM transducers may also be used.

Figure 3B:
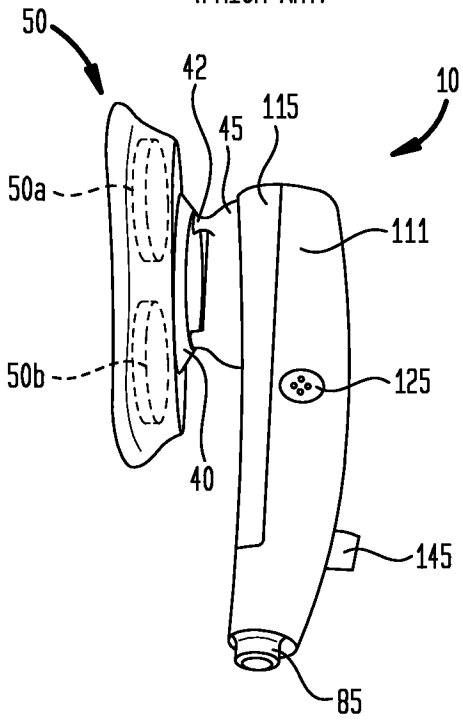
FIG. 3(b) (PRIOR ART)
FIG. 3(*a*) shows one embodiment of prior art magnetic implant 20 according to FIG. 1(*a*)
Figure 3A:
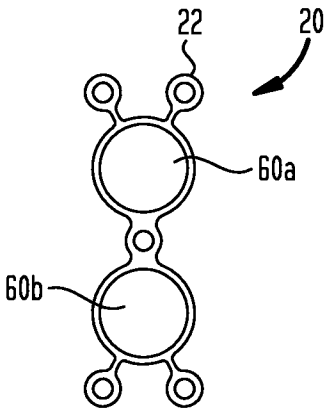
FIG. 3(a) (PRIOR ART)

FIGS. 3(*a*) and 3(*b*) show implantable bone plate or magnetic implant 20 in accordance with FIG. 1(*a*), where frame 22 has disposed thereon or therein magnetic members 60*a* and 60*b*, and where magnetic spacer 50 of hearing aid 10 has magnetic members 55*a* and 55*b* spacer disposed therein or thereon. The two magnets 60*a* and 60*b* of magnetic implant 20 of FIG. 2(*a*) permit hearing aid 10 and magnetic spacer 50 to be placed in a single position on patient's skull 70, with respective opposing north and south poles of magnetic members 55*a*, 60*a*, 55*b* and 60*b* appropriately aligned with respect to one another to permit a sufficient degree of magnetic coupling to be achieved between magnetic spacer 50 and magnetic implant 20 (see also FIG. 3(*b*)). As shown in FIG. 1(*a*), magnetic implant 20 is preferably configured to be affixed to skull 70 under patient's skin 75. In one aspect, affixation of magnetic implant 20 to skull 75 is by direct means, such as by screws 15. Other means of attachment known to those skilled in the art are also contemplated, however, such as glue, epoxy, and sutures.

Referring now to FIG. 3(*b*), there is shown a SOPHONO® ALPHA 1® hearing aid 10 configured to operate in accordance with magnetic implant 20 of FIG. 3(*a*). As shown, hearing aid 10 of FIG. 3(*b*) comprises upper housing 111, lower housing 115, magnetic spacer 50, external magnets 55*a* and 55*b* disposed within spacer 50, EM transducer diaphragm 45, metal disk 40 connecting EM transducer 25 to spacer 50, programming port/socket 125, program switch 145, and microphone 85. Not shown in FIG. 3(*b*) are other aspects of the embodiment of hearing aid 10, such as volume control 120, battery compartment 130, battery door 135, battery contacts 140, direct audio input (DAI) 150, and hearing aid circuit board 155 upon which various components are mounted, such as DSP 80.

Figure 4:
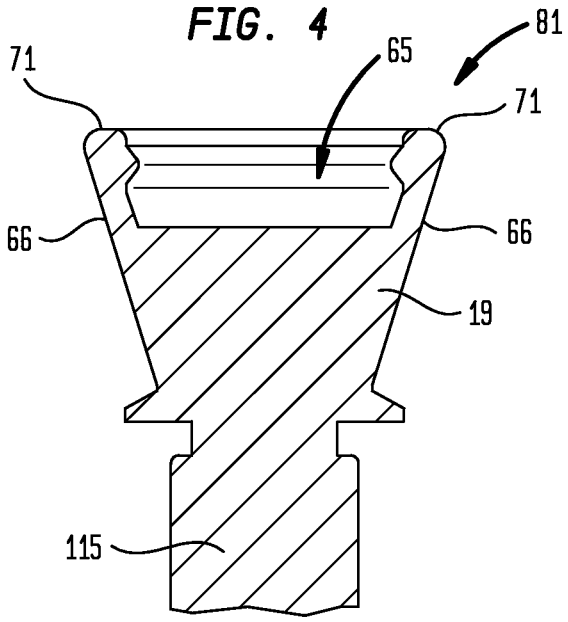
FIGS. 4 and 5 show two different embodiments of hearing aid abutments 19.
Figure 5:
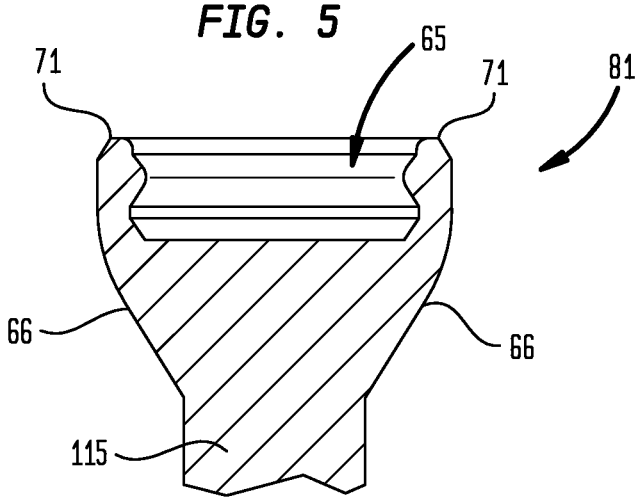

Continuing to refer to FIGS. 3(*a*) and 3(*b*), frame 22 of magnetic implant 20 holds a pair of magnets 60*a* and 60*b* that correspond to magnets 55*a* and 55*b* included in spacer 50 shown in FIG. 3(*b*). The south (S) pole and north (N) poles of magnets 55*a* and 55*b*, are respectively configured in spacer 50 such that the south pole of magnet 55*a* is intended to overlie and magnetically couple to the north pole of magnet 60*a*, and such that the north pole of magnet 55*b* is intended to overlie and magnetically couple to the south pole of magnet 60*b*. This arrangement and configuration of magnets 55*a*, 55*b*, 60*a* and 60*b* is intended permit the magnetic forces required to hold hearing aid 10 onto a patient's head to be spread out or dispersed over a relatively wide surface area of the patient's hair and/or skin 75, and thereby prevent irritation of soreness that might otherwise occur if such magnetic forces were spread out over a smaller or more narrow surface area. FIGS. 4 and 5 show two different embodiments of hearing aid abutments 19 that are attached to and form a proximal portion 81 of distally-located bone screw 115. Note that FIG. 1(*b*) discussed above shows one embodiment of such a bone screw 115 and corresponding hearing aid abutment 19.

FIG. 4 shows a first embodiment of proximal portion 81 of bone screw 115 and abutment 19, where outer shoulders 66 feature a shank that gradually and continuously reduces in diameter when moving in a distal direction. Those skilled in the art will also recognize the embodiment of abutment 19 shown in FIG. 4 as corresponding to a configuration that has been employed for several years in conjunction with different types of hearing aids provided by different manufacturers.

FIG. 5 shows a second embodiment of proximal portion 81 of bone screw 115 and abutment 19, where outer shoulders and shank 66 are convex and form a tulip-like shape and configuration. Those skilled in the art will further recognize the embodiment of abutment 19 shown in FIG. 5 as corresponding to a configuration that has been employed by COCHLEAR, Inc.™ in a bid to prevent other manufacturers from securing their hearing aids to COCHLEAR abutments and bone screws. Continuing to refer to FIGS. 4 and 5, proximal ends 81 of bone screw 115 comprise abutments 19, proximally located recesses 65, outer tapered or curved shoulders 66, and upper edges 71 disposed between shoulders 66 and recess 64. Shapes and configurations of outer tapered or curved shoulders 66 other than those shown explicitly in FIGS. 4 and 5 are contemplated. Various means of operably coupling or attaching hearing aids 10 to abutment members 19 such as those shown in FIGS. 4 and 5 are known in the art, where such attachment means are configured to operably couple to recesses 65 of abutments 19 only. According to various embodiments described and disclosed herein, however, abutment attachment mechanisms 87 are configured to operably couple and attach to outer tapered or curved shoulders 66 of hearing aid abutments 19, and/or to operably couple and attach to outer tapered or curved shoulders 66 and recesses 65 and/or upper edges 71 of hearing aid abutments 19, more about which said below.

Figure 6A:
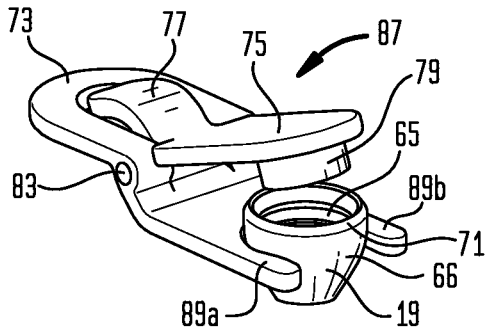
FIGS. 6(*a*) and 6(*b*) show one embodiment of hearing aid abutment attachment mechanism 87.
Figure 6B:
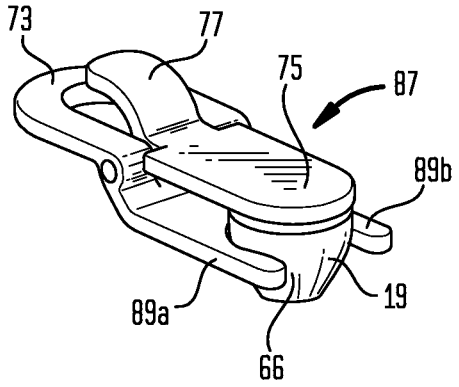

Referring to FIGS. 6(*a*) and 6(*b*), there is shown one embodiment of a hearing aid abutment attachment mechanism 87. In the embodiment shown in FIGS. 6(*a*) and 6(*b*), as in other embodiments described and disclosed herein, hearing aid 10 (not shown in FIGS. 6(*a*) and 6(*b*)) may be attached directly to abutment attachment mechanism 87, or may be attached to an intervening spacer, which in turn is attached or secured to abutment attachment mechanism 87. In either case, hearing aid 10 or spacer 50 may be attached or secured to abutment attachment mechanism 87 by means of mechanical fasteners such as screws or bolts, adhesives such as epoxy, overmolding, by employing magnetic coupling forces between hearting 10 and abutment attachment mechanism 87, or between spacer 50 and abutment attachment mechanism 87, or by attaching members 17 or 40 (see, for example, FIGS. 1(*a*) and 1(*b*) above) directly to abutment attachment mechanism 87. Further means of operably coupling abutment attachment mechanism 87 to hearing aid 10 are also contemplated.

Continuing to refer to FIGS. 6(*a*) and 6(*b*), one embodiment of hearing aid abutment attachment mechanism 87 and abutment 19 are shown. Abutment attachment mechanism 87 is configured to form a portion of a magnetic hearing aid system comprising a bone conduction hearing aid 10 comprising EM transducer 25. Hearing aid abutment attachment mechanism 87 is configured to be operably coupled to EM transducer 25, and to be operably coupled to hearing aid abutment 19, which is attached to or forms an external portion of bone screw 115 implanted in patient's skull 75. As described above, spacer 50, or any other suitable intervening member, may be interposed between hearing aid 10 and abutment attachment mechanism 19.

As further shown in FIGS. 6(*a*) and 6(*b*), abutment attachment mechanism 87 is configured to fit over and engage proximal end 81 of hearing aid abutment 19, and to apply compressive axially directed forces between tapered or curved outer shoulders 66 of abutment 16 and at least one of: (i) upper edge 71 located at or near a proximal end of abutment 19, and (ii) recess 65 located at or near the proximal end of abutment 19. The application of such compressive axial forces results in abutment attachment mechanism 87 and hearing aid 10 being operably coupled and mechanically secured to abutment 19.

Still referring to FIGS. 6(*a*) and 6(*b*), abutment attachment mechanism 87 comprises handle 73, lid or cover 75, lever or button 77, boss, interference member or protruding member 79, hinge 83, protruding flanges 89*a* and 89*b*, and curved surface 91 disposed between flanges 93*a* and 93*b*. Lid or cover 75 is hingeably connected via hinge 83 to handle 73, and is configured to be disposed over recess 65 such that boss, interference member or protruding member 79 fits within recess 65 while flanges 89*a* and 89*b*, and curved surface 91 disposed between flanges 93*a* and 93*b*, engage the shank of bone screw 115 around outer tapered or curved shoulders 66 of hearing aid abutment 19. Lid or cover 75 may also be spring-loaded and biased normally to remain in a closed position. A patient or health care provider can thus operably snap or place abutment attachment mechanism 87 onto abutment 19.

Figure 7A:
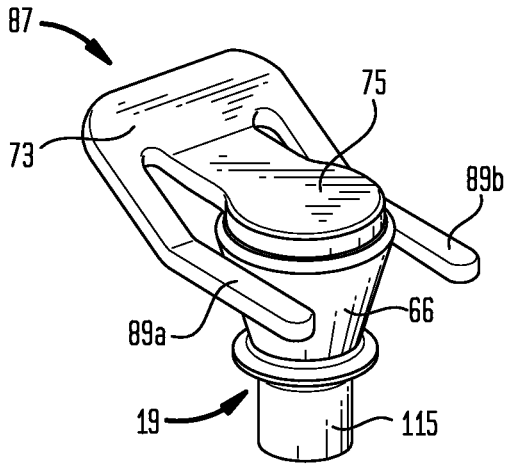
FIGS. 7(*a*) through 7(*c*) show another embodiment of hearing aid abutment attachment mechanism 87.
Figure 7B:
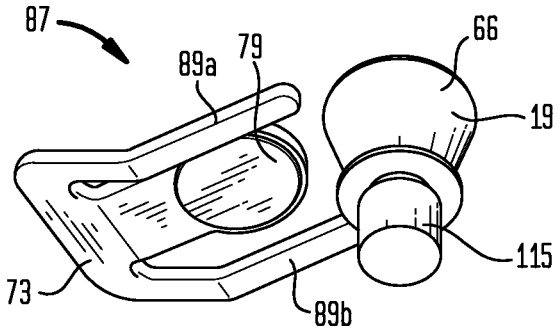
Figure 7C:
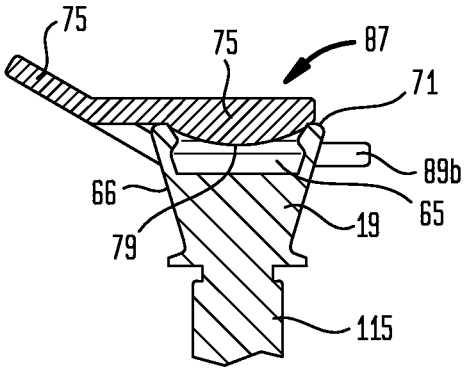
Figure 8A:
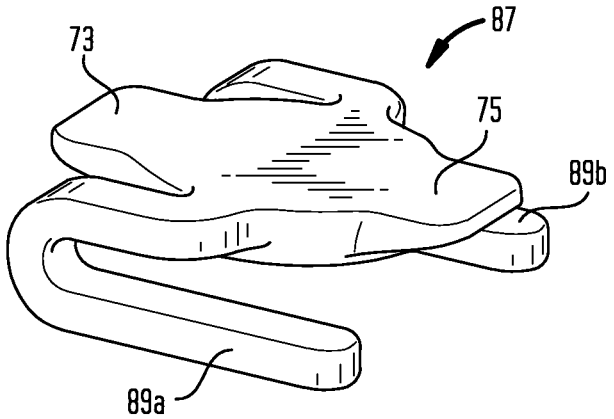
FIGS. 8(*a*) through 8(*d*) show yet another embodiment of hearing aid abutment attachment mechanism 87.
Figure 8B:
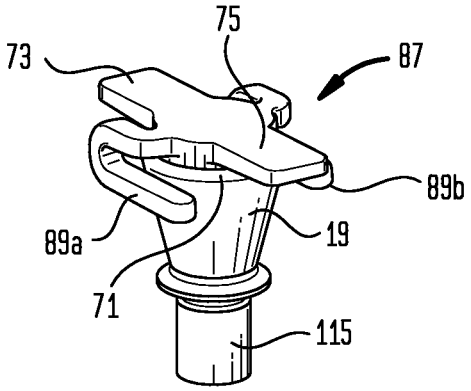
Figure 8C:
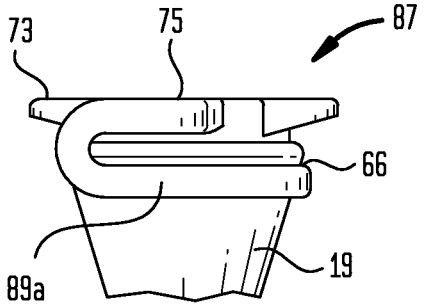
Figure 8D:
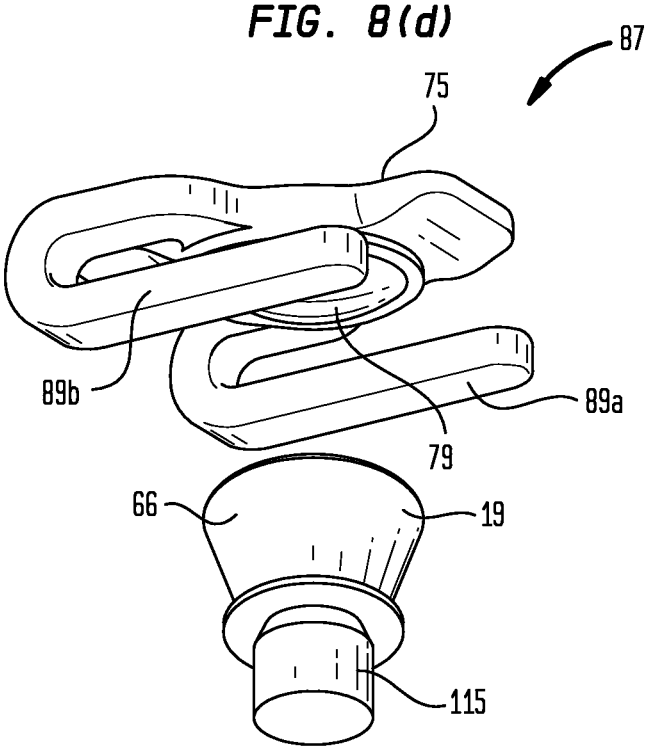

FIGS. 7(*a*) through 7(*c*) show another embodiment of abutment attachment mechanism 87, which features a flexible or bendable portion disposed between cover or lid 75 and handle 73, and which is configured to hold or bias cover or lid 75 onto proximal end 81 of abutment 19 once mechanism 87 has been secured to abutment 19 by a patient or health care provider. FIG. 7(*a*) shows a top perspective view of abutment attachment mechanism 87 and abutment 19, while FIGS. 7(*b*) and 7(*c*) show bottom perspective and cross-sectional views of abutment attachment mechanism 87 and abutment 19.

As in the embodiment illustrated in FIGS. 6(*a*) and 6(*b*), abutment attachment mechanism 87 of FIGS. 7(*a*) through 7(*c*) includes protruding flanges 89*a* and 89*b*, which are configured to engage the shank of bone screw 115 around outer tapered or curved shoulders 66 of hearing aid abutment 19. When abutment attachment mechanism 87 is mounted on abutment 19, protruding flanges 89*a* and 89*b* apply upwardly-directed compressive axial forces against shoulders 66 while cover or lid 75 and boss or interference member 79 apply downwardly-directed compressive axial forces against recess 65 and/or upper edges 71.

FIGS. 8(*a*) through 8(*d*) show yet another embodiment of abutment attachment mechanism 87, which is also configured to hold or bias cover or lid 75 onto proximal end 81 of abutment 19 once mechanism 87 has been secured to abutment 19 by a patient or health care provider. FIG. 7(*a*) shows a top perspective view of abutment attachment mechanism 87 only. FIGS. 8(*b*), 8(*c*) and d(c) show top perspective, side and bottom perspective views of abutment attachment mechanism 87 and abutment 19.

Figure 9A:
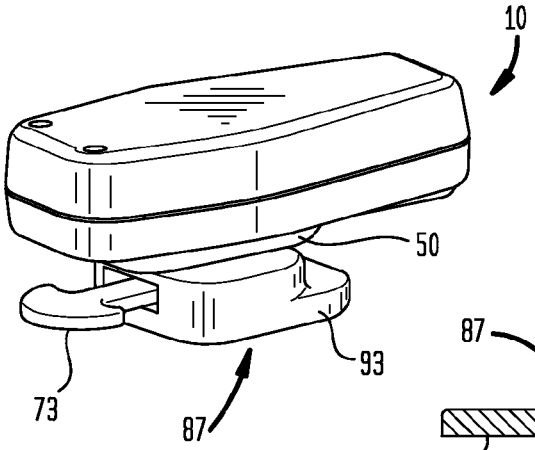
FIGS. 9(*a*), 9(*b*), 9(*c*), 9(*d*), 9(*e*), 9(*f*) and 9(*g*) show a further embodiment of hearing aid abutment attachment mechanism 87, FIGS. 10(*a*) through 10(*d*) show yet a further embodiment of hearing aid abutment attachment mechanism 87.
Figure 9B:
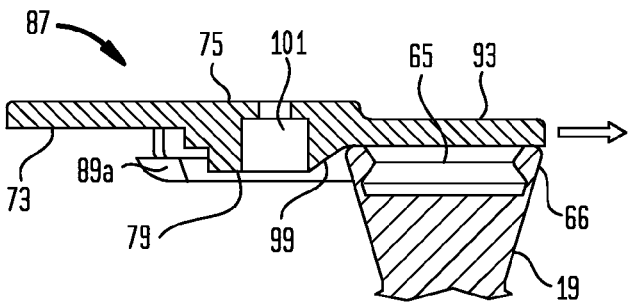
Figure 9C:
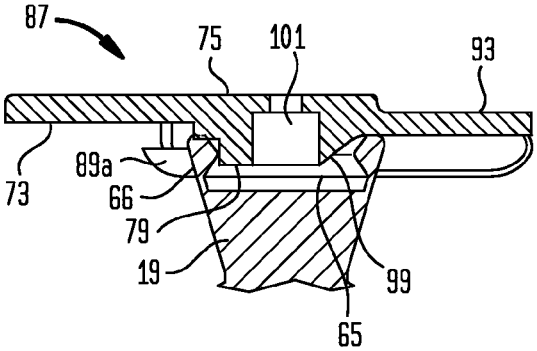
Figure 9D:
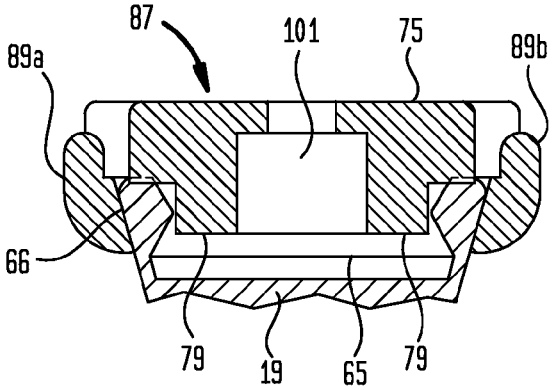
Figure 9E:
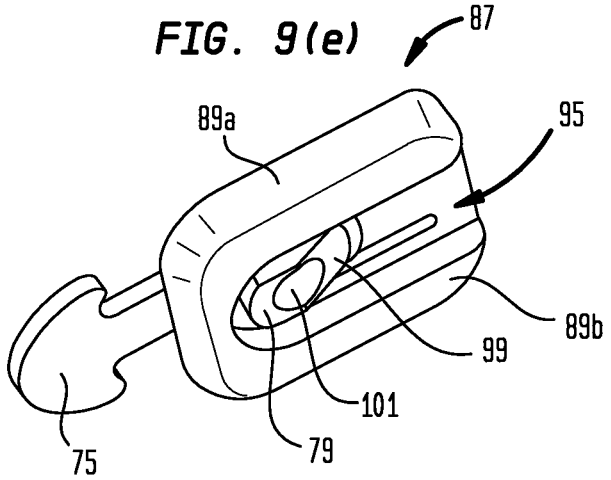
Figure 9F:
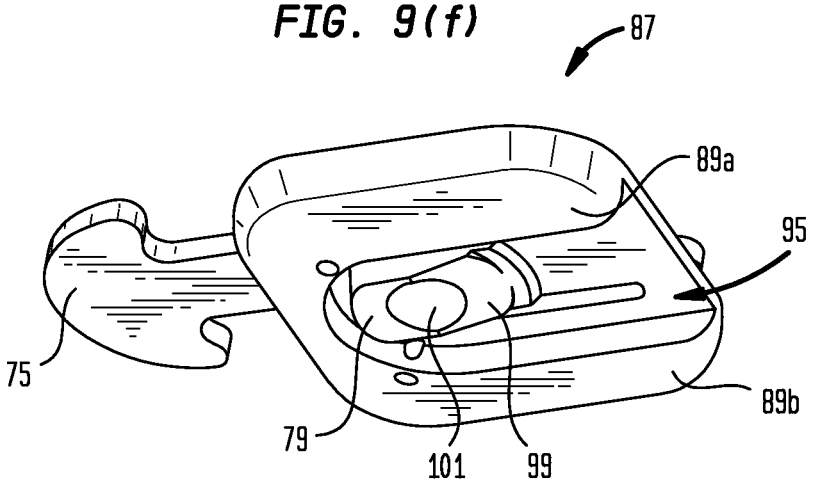
Figure 9G:
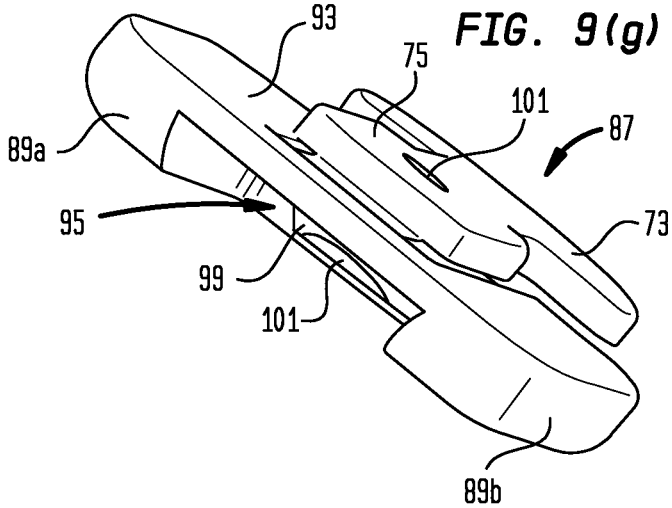
Figure 10A:
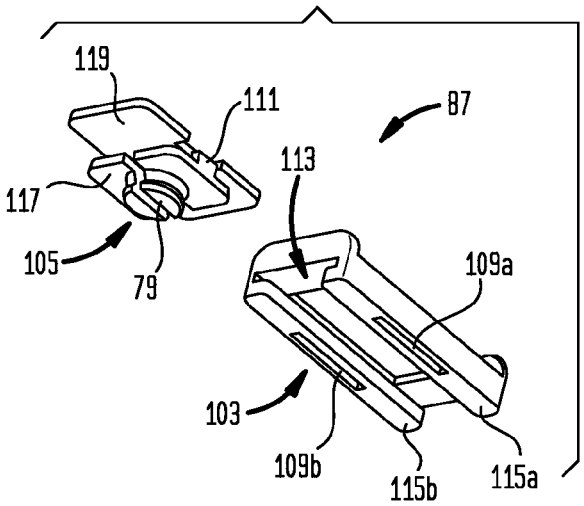
Figure 10B:
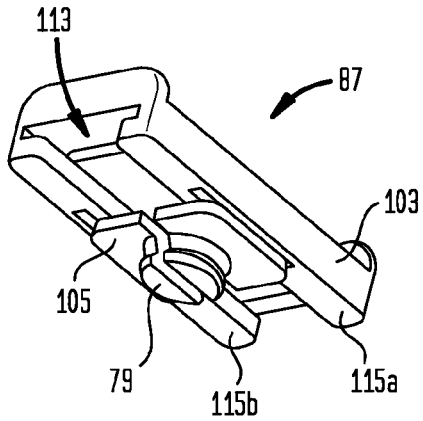
Figure 10C:
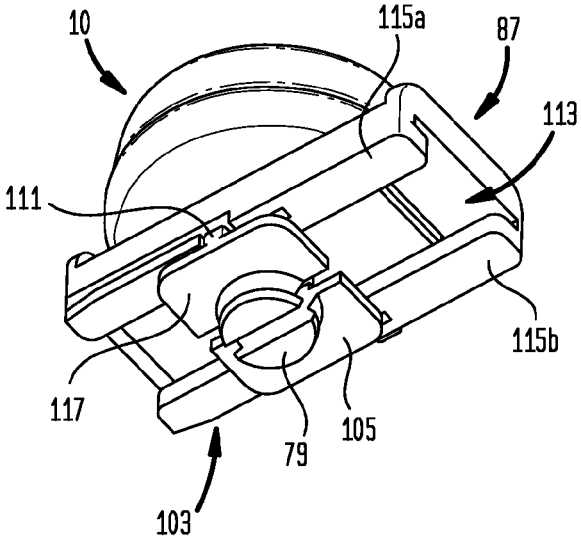
Figure 10D:
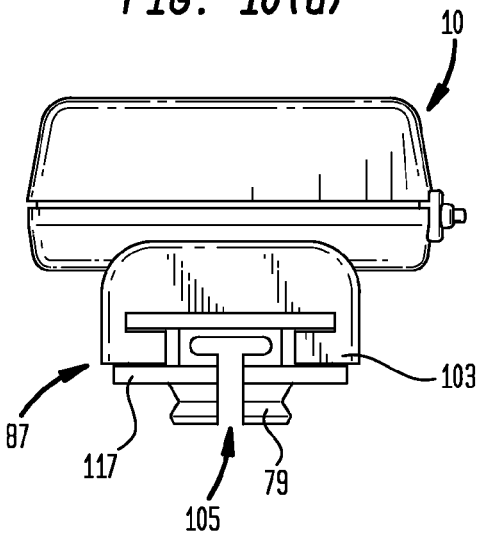

As in the embodiments illustrated in FIGS. 6(*a*), 6(*b*), 7(*a*), 7(*b*) and 7(*c*), abutment attachment mechanism 87 of FIGS. 8(*a*) through 8(*d*) includes protruding flanges 89*a* and 89*b*, which are also configured to engage the shank of bone screw 115 around outer tapered or curved shoulders 66 of hearing aid abutment 19. When abutment attachment mechanism 87 is mounted on abutment 19, protruding flanges 89*a* and 89*b* apply upwardly-directed compressive axial forces against shoulders 66 while cover or lid 75 and boss or interference member 79 apply downwardly-directed compressive axial forces against recess 65 and/or upper edges 71. In contrast to the embodiments shown in FIGS. 6(*a*) through 7(*c*), however, protruding flanges 89*a* and 89*b* of FIGS. 8(*a*) through 8(*d*) project rearwardly from cover or lid 75 before reversing direction and projecting forwardly. FIGS. 9(*a*) through 9(*g*) show still another embodiment of abutment attachment mechanism 87, which is configured to slide onto abutment 19 and then lock into recess 65 of abutment 19, and thus hold or bias cover or lid 75 onto proximal end 81 of abutment 19. FIG. 8(*a*) shows a top perspective view of hearing aid 10 and spacer 50 mounted atop abutment attachment mechanism 87. FIG. 9*b*) shows abutment attachment mechanism 87 of FIG. 9(*a*) in a pre-locking configuration with respect to abutment 19. Ramped surface 99 disposed on the underside of abutment attachment mechanism 87 is shaped and configured to permit abutment attachment mechanism 87 to slide onto abutment 19. FIG. 9(*c*) shows abutment attachment mechanism 87 locked onto abutment 19 after protruding member 79 has been pushed into recess 65. FIG. 9(*d*) shows an end cross-sectional view of abutment attachment mechanism 87 and abutment 19 in the locked configuration of FIG. 9(*c*).

FIGS. 9(*e*) through 9(*f*) show bottom right, bottom left, and top left perspective views of abutment attachment mechanism 87. Slot 95 disposed in the underside of abutment attachment mechanism 87 is configured to receive slideably distal end 81 of abutment 19 therein. Ramped surface 99 permits upper edge 71 and distal end 81 of abutment 19 to be pushed into recess 101 for locking engagement of protruding member 79 and recess 65.

According to one embodiment, hole or recess 101 in FIGS. 9(*a*) through 9(*g*) is employed to receive a screw or a bolt and corresponding nut therethrough for attachment of abutment attachment mechanism 87 to hearing aid 10 or spacer 50. FIGS. 10(*a*) through 10(*d*) show still another embodiment of abutment attachment mechanism 87, which comprises carrier 103 and slide 105. FIG. 10(*a*) is a bottom left exploded perspective view of abutment attachment mechanism 87. FIG. 10(*b*) is a bottom left assembled perspective view of abutment attachment mechanism 87. FIG. 10(*c*) is a bottom right perspective view of abutment attachment mechanism 87 attached to hearing aid 10. FIG. 10(*d*) is an end view of abutment attachment mechanism 87 attached to hearing aid 10.

As shown in FIGS. 10(*a*) and 10(*b*), protruding member 79 of slide 105 is configured to fit into and exert radially-outwardly-directed forces on recess 65 of abutment 19. Slide 105 is configured to slide into slot 113 of carrier 103 using arms 119. Tabs 111 on arms 117 lock into corresponding tab slots 109 formed in the underside of carrier 105. As further seen in the embodiment illustrated in FIGS. 10(*a*) through 10(*d*), protruding member 79 comprises two downwardly projecting halves that may be pushed radially inward when protruding member 79 is being pushed down into recess 65 of abutment 19. Once located fully inside recess 65, these halves expand radially to secure abutment attachment mechanism 87 to abutment 19.

Note that abutment attachment mechanism 87 may be formed of metal, a metal alloy, plastic, one or more polymers, or other suitable materials.

In some embodiments, spacer 50 is configured to be mechanically and acoustically coupled to EM transducer 25, and to be acoustically and mechanically or magnetically coupled to an external hearing aid abutment 19 through abutment attachment mechanism 87. Various means and methods for magnetically coupling spacer 50 and/or hearing aid 10 to other components of a hearing aid system are disclosed and described in the above-referenced three patent applications to Kasic et al. filed on even date herewith, which as those skilled in the art will now understand may be modified and adapted for use in accordance with the various embodiments of abutment attachment mechanisms 87 disclosed and described herein. For example, in some embodiments abutment attachment mechanism 87 may include one or more magnetic or ferrous members that are configured to magnetically couple to hearing aid 10, to spacer 50, or to any other suitable device or component interposed between abutment attachment mechanism 87 and hearing aid 10.

See, for example, U.S. Pat. No. 7,021,676 to Westerkull entitled "Connector System," U.S. Pat. No. 7,065,223 to Westerkull entitled "Hearing-Aid Interconnection System," and U.S. Design Pat. No. D596,925 S to Hedstrom et al., which disclose bone screws, abutments and hearing aids that may be modified in accordance with the teachings and disclosure made herein, each of which is hereby incorporated by reference herein, each in its respective entirety.

The above-described embodiments should be considered as examples of the present invention, rather than as limiting the scope of the invention. In addition to the foregoing embodiments of the invention, review of the detailed description and accompanying drawings will show that there are other embodiments of the present invention. Accordingly, many combinations, permutations, variations and modifications of the foregoing embodiments of the present invention not set forth explicitly herein will nevertheless fall within the scope of the present invention.

We claim:

1. A hearing aid system, comprising:

a bone conduction hearing aid comprising an electromagnetic ("EM") transducer, and a hearing aid abutment attachment mechanism operably coupled to the EM transducer, the abutment attachment mechanism being configured to be mechanically and acoustically coupled to a hearing aid abutment attached to or forming an external portion of a bone screw implanted in a patient's skull;

wherein the abutment attachment mechanism is configured to fit onto or over the hearing aid abutment and apply compressive axially directed mechanical forces between tapered or curved outer shoulders of a shank of the abutment and at least one of: (i) an upper edge of the abutment, and (ii) a recess located in the abutment, such that the abutment attachment mechanism and corresponding hearing aid may be operably coupled and mechanically secured to the abutment, and further wherein at least one of a mechanical fastener, an adhesive, and an overmolding is employed to attach the hearing aid or a spacer to the abutment attachment mechanism.

2. The hearing aid system of claim 1, wherein the abutment to which the abutment attachment mechanism is shaped and configured to be coupled is tulip-shaped.

3. The hearing aid system of claim 1, wherein the abutment to which the abutment attachment mechanism is shaped and configured to be coupled comprises a shank that gradually and continuously reduces in diameter when moving in a distal direction away from the bone conduction hearing aid.

4. The hearing aid system of claim 1, wherein a spacer is disposed between the hearing aid and the abutment attachment mechanism.

5. The hearing aid system of claim 1, wherein the abutment attachment mechanism comprises a handle, a cover, a protruding member disposed on an underside of the cover, and dual protruding flanges.

6. The hearing aid system of claim 5, wherein the protruding member is shaped and configured to provide an interference fit with the recess.

7. The hearing aid system of claim 5, wherein the abutment attachment mechanism comprises a recess in the abutment, wherein the protruding member comprises a ramped surface configured to engage and slide over the shank of the abutment such that at least portions of the protruding member are received within the recess.

8. The hearing aid system of claim 1, wherein the abutment attachment mechanism is configured to slide onto and engage at least portions of the shank of the abutment.

9. The hearing aid system of claim 1, wherein the abutment attachment mechanism is formed at least partially of plastic, a polymer, a metal, or a metal alloy.

10. A hearing aid system comprising:

a bone conduction hearing aid comprising an electromagnetic ("EM") transducer, and a hearing aid abutment attachment mechanism operably coupled to the EM transducer, the abutment attachment mechanism being configured to be mechanically and acoustically coupled to a hearing aid abutment attached to or forming an external portion of a bone screw implanted in a patients skull;

wherein the abutment attachment mechanism is configured to fit onto or over the hearing aid abutment and apply compressive axially directed mechanical forces between tapered or curved outer shoulders of a shank of the abutment and at least one of: (i) an upper edge of the abutment, and (ii) a recess located in the abutment, such that the abutment attachment mechanism and corresponding hearing aid may be operably coupled and mechanically secured to the abutment, and further wherein at least one of a mechanical fastener, an adhesive, an overmolding and a magnetic coupling device is employed to attach the hearing aid or a spacer to the abutment attachment mechanism, and wherein the abutment attachment mechanism comprises a handle, a cover, a lever, a protruding member disposed on an underside of the cover, and dual protruding flanges.

11. The hearing aid system of claim 10, wherein the abutment attachment mechanism comprises a recess in the abutment, wherein the cover is hingeably connected to the handle, and the protruding member is configured to be received at least partially by the recess while the flanges engage the shank of the abutment thereby to apply the compressive axially directed forces.

12. The hearing aid system of claim 10, wherein the cover is spring-loaded.

13. The hearing aid system of claim 10, wherein the abutment attachment mechanism comprises a recess in the abutment, wherein the protruding member is shaped and configured to provide an interference fit with the recess.

14. A hearing aid system comprising:

a bone conduction hearing aid comprising an electromagnetic ("EM") transducer, and a hearing aid abutment attachment mechanism operably coupled to the EM transducer, the abutment attachment mechanism being configured to be mechanically and acoustically coupled to a hearing aid abutment attached to or forming an external portion of a bone screw implanted in a patient's skull;

wherein the abutment attachment mechanism is configured to fit onto or over the hearing aid abutment and apply compressive axially directed mechanical forces between tapered or curved outer shoulders of a shank of the abutment and at least one of: (i) an upper edge of the abutment, and (ii) a recess located in the abutment, such that the abutment attachment mechanism and corresponding hearing aid may be operably coupled and mechanically secured to the abutment, and further wherein at least one of a mechanical fastener, an adhesive, an overmolding and a magnetic coupling device is employed to attach the hearing aid or a spacer to the abutment attachment mechanism, wherein the abutment attachment mechanism comprises a handle, a cover, a protruding member disposed on an underside of the cover, and dual protruding flanges, and wherein a flexible or bendable portion is disposed between the cover and the handle, and the protruding member is configured to be received at least partially by the at least one of: (i) the upper edge of the abutment, and (ii) the recess located in the abutment, while the flanges engage the shank of the abutment thereby to apply the compressive axially directed forces.

15. An abutment attachment mechanism configured for use in a hearing aid system that includes a bone conduction hearing aid comprising an electromagnetic ("EM") transducer, the abutment attachment mechanism being configured to be operably coupled to the EM transducer and to be mechanically and acoustically coupled to a hearing aid abutment attached to or forming an external portion of a bone screw implanted in a patient's skull, wherein the abutment attachment mechanism is further configured to fit onto or over the hearing aid abutment and apply compressive axially directed forces between tapered or curved outer shoulders of a shank of the abutment and at least one of: (i) an upper edge of the abutment, and (ii) a recess located in the abutment, such that the abutment attachment mechanism and corresponding hearing aid may be operably coupled and mechanically secured to the abutment, and further wherein at least one of a mechanical fastener, an adhesive, and an overmolding is employed to attach the hearing aid or a spacer to the abutment attachment mechanism.

16. The abutment attachment mechanism of claim 15, wherein the abutment to which the abutment attachment mechanism is shaped and configured to be coupled is tulip-shaped.

17. The abutment attachment mechanism of claim 15, wherein the abutment to which the abutment attachment mechanism is shaped and configured to be coupled comprises the shank, wherein the shank gradually and continuously reduces in diameter when moving in a distal direction away from the bone conduction hearing aid.

18. The abutment attachment mechanism of claim 15, wherein the abutment attachment mechanism comprises a handle, a cover, a protruding member disposed on an underside of the cover, and dual protruding flanges.

19. The abutment attachment mechanism of claim 18, wherein the abutment attachment mechanism comprises a recess in the abutment wherein the protruding member is shaped and configured to provide an interference fit with the recess.

20. The abutment attachment mechanism of claim 15, wherein the abutment attachment mechanism is configured to slide onto and engage at least portions of the shank of the abutment.

21. The abutment attachment mechanism of claim 15, wherein the abutment attachment mechanism is formed at least partially of plastic, a polymer, a metal, or a metal alloy.

22. An abutment attachment mechanism configured for use in a hearing aid system that includes a bone conduction hearing aid comprising an electromagnetic ("EM") transducer, the abutment attachment mechanism being configured to be operably coupled to the EM transducer and to be mechanically and acoustically coupled to a hearing aid abutment attached to or forming an external portion of a bone screw implanted in a patient's skull, wherein the abutment attachment mechanism is further configured to fit onto or over the hearing aid abutment and apply compressive axially directed forces between tapered or curved outer shoulders of a shank of the abutment and at least one of: (i) an upper edge of the abutment, and (ii) a recess located in the abutment, such that the abutment attachment mechanism and corresponding hearing aid may be operably coupled and mechanically secured to the abutment, and further wherein at least one of a mechanical fastener, an adhesive, an overmolding, and a magnetic coupling device is employed to attach the hearing aid or a spacer to the abutment attachment mechanism, and wherein the abutment attachment mechanism comprises a handle, a cover, a lever, a protruding member disposed on an underside of the cover, and dual protruding flanges.

23. The abutment attachment mechanism of claim 22, wherein the abutment attachment mechanism comprises a recess in the abutment, wherein the cover is hingeably connected to the handle, and the protruding member is configured to be received at least partially by the recess while the flanges engage the shank of the abutment thereby to apply the compressive axially directed forces.

24. The abutment attachment mechanism of claim 22, wherein the cover is spring-loaded.

25. The abutment attachment mechanism of claim 22, wherein the abutment attachment mechanism comprises a recess in the abutment, wherein the protruding member is shaped and configured to provide an interference fit with the recess.

26. An abutment attachment mechanism configured for use in a hearing aid system that includes a bone conduction hearing aid comprising an electromagnetic ("EM") transducer, the abutment attachment mechanism being configured to be operably coupled to the EM transducer and to be mechanically and acoustically coupled to a hearing aid abutment attached to or forming an external portion of a bone screw implanted in a patient's skull, wherein the abutment attachment mechanism is further configured to fit onto or over the hearing aid abutment and apply compressive axially directed forces between tapered or curved outer shoulders of a shank of the abutment and at least one of: (i) an upper edge of the abutment, and (ii) a recess located in the abutment, such that the abutment attachment mechanism and corresponding hearing aid may be operably coupled and mechanically secured to the abutment, and further wherein at least one of a mechanical fastener, an adhesive, an overmolding, and a magnetic coupling device is employed to attach the hearing aid or a spacer to the abutment attachment mechanism, wherein the abutment attachment mechanism comprises a handle, a cover, a protruding member disposed on an underside of the cover, and dual protruding flanges, and wherein a flexible or bendable portion is disposed between the cover and the handle, and the protruding member is configured to be received at least partially by the at least one of: (i) the upper edge of the abutment, and (ii) the recess located in the abutment while the flanges engage the shank of the abutment thereby to apply the compressive axially directed forces.

27. An abutment attachment mechanism configured for use in a hearing aid system that includes a bone conduction hearing aid comprising an electromagnetic ("EM") transducer, the abutment attachment mechanism being configured to be operably coupled to the EM transducer and to be mechanically and acoustically coupled to a hearing aid abutment attached to or forming an external portion of a bone screw implanted in a patient's skull, wherein the abutment attachment mechanism is further configured to fit onto or over the hearing aid abutment and apply compressive axially directed forces between tapered or curved outer shoulders of a shank of the abutment and at least one of: (i) an upper edge of the abutment, and (ii) a recess located in the abutment, such that the abutment attachment mechanism and corresponding hearing aid may be operably coupled and mechanically secured to the abutment, and further wherein at least one of a mechanical fastener, an adhesive, an overmolding, and a magnetic coupling device is employed to attach the hearing aid or a spacer to the abutment attachment mechanism, wherein the abutment attachment mechanism is configured to slide onto and engage at least portions of the shank of the abutment, and wherein the abutment attachment mechanism further comprises a protruding member having a ramped surface configured to engage and slide over the shank of the abutment such that at least portions of the protruding member are received by the at least one of: (i) the upper edge of the abutment, and (ii) the recess located in the abutment.

28. A hearing aid system, comprising:

a bone conduction hearing aid comprising an electromagnetic ("EM") transducer, and a hearing aid abutment attachment mechanism operably coupled to the EM transducer, the abutment attachment mechanism being configured to be mechanically and acoustically coupled to a hearing aid abutment attached to or forming an external portion of a bone screw implanted in a patient's skull;

wherein the abutment attachment mechanism is further configured to fit onto or over the hearing aid abutment and to apply radially outwardly directed forces to a recess located in the abutment, such that the abutment attachment mechanism and corresponding hearing aid may be operably coupled and mechanically secured to the abutment, and further wherein at least one of a mechanical fastener, an adhesive, and an overmolding is employed to attach the hearing aid or a spacer to the abutment attachment mechanism.

29. The hearing aid system of claim 28, wherein the abutment to which the abutment attachment mechanism is shaped and configured to be coupled is tulip-shaped.

30. The hearing aid system of claim 28, wherein the abutment to which the abutment attachment mechanism is shaped and configured to be coupled comprises a shank that gradually and continuously reduces in diameter when moving in a distal direction away from the bone conduction hearing aid.

31. The hearing aid system of claim 28, wherein the abutment further comprises a protruding member configured to provide the radially outwardly directed forces.

32. The hearing aid system of claim 31, wherein the protruding member forms a portion of or is attached to a slide.

33. A hearing aid system comprising:

a bone conduction hearing aid comprising an electromagnetic ("EM") transducer, and a hearing aid abutment attachment mechanism operably coupled to the EM transducer, the abutment attachment mechanism being configured to be mechanically and acoustically coupled to a hearing aid abutment attached to or forming an external portion of a bone screw implanted in a patient's skull;

wherein the abutment attachment mechanism is further configured to fit onto or over the hearing aid abutment and to apply radially outwardly directed forces to a recess located in the abutment, such that the abutment attachment mechanism and corresponding hearing aid may be operably coupled and mechanically secured to the abutment, and further wherein at least one of a mechanical fastener, an adhesive, an overmolding and a magnetic coupling device is employed to attach the hearing aid or a spacer to the abutment attachment mechanism, wherein a protruding member forms a portion of or is attached to a slide, and wherein the abutment attachment mechanism further comprises a carrier configured to receive the slide.

* * * * *